US011603980B1

(12) United States Patent
Chen

(10) Patent No.: US 11,603,980 B1
(45) Date of Patent: Mar. 14, 2023

(54) CRYSTAL LAMPSHADE

(71) Applicant: Huizhou Ruoyuxuan Lighting Co., Ltd., Huizhou (CN)

(72) Inventor: Jiansheng Chen, Huizhou (CN)

(73) Assignee: Huizhou Ruoyuxuan Lighting Co., Ltd., Huizhou (CN)

( * ) Notice: Subject to any disclaimer, the term of this patent is extended or adjusted under 35 U.S.C. 154(b) by 0 days.

(21) Appl. No.: 17/871,484

(22) Filed: Jul. 22, 2022

(30) Foreign Application Priority Data

Jun. 25, 2022 (CN) ..... 202221605429.X

(51) Int. Cl.
*F21V 1/20* (2006.01)
*F21V 1/14* (2006.01)
*F21V 1/04* (2006.01)

(52) U.S. Cl.
CPC ..... *F21V 1/20* (2013.01); *F21V 1/04* (2013.01); *F21V 1/143* (2013.01)

(58) Field of Classification Search
CPC .... F21V 1/14; F21V 1/20; F21V 1/143; F21S 8/04
See application file for complete search history.

(56) References Cited

U.S. PATENT DOCUMENTS 4,467,405 A * 8/1984 Weber ..... F21V 17/12 362/450
4,541,038 A * 9/1985 Van Noord ..... F21V 1/06 362/351
5,857,765 A * 1/1999 Deron ..... F21V 17/102 362/405

FOREIGN PATENT DOCUMENTS

GB 2189017 A * 10/1987 ..... F21V 1/20

* cited by examiner

*Primary Examiner* — Mariceli Santiago
(74) *Attorney, Agent, or Firm* — Jeenam Park

(57) ABSTRACT

The present invention provides a crystal lampshade, which belongs to the technical field of lampshade. The crystal lampshade comprises a hanging rod assembly and a lampshade assembly. When in use, the crystal slabs are respectively inserted between the upper cover and the lower cover, and then the hanging bracket is threadedly sleeved onto the hanging bracket through the pressing sleeve, the pressing frame is sleeved in the hanging bracket, a lower end of the hanging bracket passes through the lower cover, installing a decorative cover, and rotating the pressing sleeve, and the pressing frame is gradually pressed onto the upper side of the upper cover by the pressing sleeve, the decoration cover tightly presses against the lower side of the lower cover, thus fixing and limiting the positions of the upper cover and the lower cover, and stabilizing the crystal slabs.

9 Claims, 8 Drawing Sheets

CRYSTAL LAMPSHADE

CROSS-REFERENCE TO RELATED APPLICATIONS

This application claims priority to Chinese Application Serial No. 202221605429.X, filed on Jun. 25, 2022. The content of the aforementioned application, including any intervening amendments thereto, is incorporated herein by reference.

TECHNICAL FIELD

The present invention relates to the field of lampshade, and in particular to a crystal lampshade.

BACKGROUND

The crystal lamp is made of K9 crystal material, has a wide impact in China, and has a long history in various countries around the world. It has beautiful quality, bright appearance, sparkling, crystal clear, so it has become a favorite of people. Crystal lighting originates from the mid-18th century in Europe. During the "Rococo" period. Europeans were particularly longing for ornate objects and decorations, and crystal lighting came into being and became very popular. Crystal lamps are loved and purchased by many consumers because they can bring elegance and fashion to the room.

The traditional crystal lampshade has the following technical problems:

1. The crystal lampshade is integrally cast, which is inconvenient to install, and needs to be replaced as a whole when damaged.

2. it is fixed by a simple snap connection, lacks corresponding compression stability, and is easy to loosen when subjected to external force, which increases the risk of local crystal plates falling easily.

How to develop a crystal lampshade to solve these problems has become a problem to be solved urgently by a person skilled in the art.

SUMMARY

In order to remedy the above defects, the present invention provides a crystal lampshade, which aims to solve the problems mentioned in the above background art.

The present invention is implemented as follows:

A crystal lampshade comprises a hanging rod assembly and a lampshade assembly.

The hanging rod assembly comprises a hanging bracket, a decorative cover, a pressing sleeve and a pressing frame, wherein the decorative cover is fixedly connected to a bottom end of the hanging bracket, the pressing sleeve is threadedly sleeved on the hanging bracket, the pressing frame is slidably sleeved on the hanging bracket, and the lampshade assembly comprises an upper cover, a lower cover and crystal slabs, two ends of the crystal slab are respectively inserted between the upper cover and the lower cover, and the crystal slabs are arranged at equal intervals along the periphery of the upper cover, a lower end of the hanging bracket passes through the lower cover, the decorative cover is pressed against the lower cover, and the pressing sleeve presses the pressing frame against the upper cover.

In a specific embodiment, the pressing frame comprises a pressing plate and pressing strips, wherein the pressing strips are arranged at equal intervals on the periphery of the pressing plate, and the pressing strips are pressed against the upper cover respectively.

In a specific embodiment, a fixing sleeve is threadedly sleeved on the lower end of the hanging bracket, and the fixing sleeve is tightly pressed against an upper side of the lower cover.

In a specific embodiment, the upper cover comprises an annular cover body, the annular cover body is uniformly provided with mounting grooves, and an upper end of the crystal slab is plugged into the mounting groove.

In a specific embodiment, the lower cover comprises a pressing cover plate and a positioning cover plate, the positioning cover plate and the annular cover body are configured to have the same structure, a lower end of the crystal slab is inserted into the mounting groove on the positioning cover plate, and the decorative cover is pressed against a lower side of the pressing cover plate.

In a specific embodiment, the crystal slab comprises a crystal piece and bumps, the bumps are respectively arranged at upper and lower ends of the crystal piece, and the humps are respectively inserted into the mounting groove of the annular cover body and the positioning cover plate.

In a particular embodiment, the crystal piece comprises a crystal sheet and a metal frame, the crystal sheet is embedded into the metal frame.

In a specific embodiment, the crystal sheet is formed by adhering and casting crystal particles and epoxy adhesive.

In a specific embodiment, a vertical partition plate is disposed between the crystal slabs, slots are correspondingly arranged on peripheries of the annular cover body, the pressing cover plate and the positioning cover plate, and upper and lower ends of the vertical partition plate are respectively inserted into the slot.

Beneficial effects of the present application are as follows: when in use, the crystal slabs are respectively inserted between the upper cover and the lower cover, and then the hanging bracket is threadedly sleeved onto the hanging bracket through the pressing sleeve, the pressing frame is sleeved in the hanging bracket, a lower end of the hanging bracket passes through the lower cover, installing a decorative cover, and rotating the pressing sleeve, and the pressing frame is gradually pressed onto the upper side of the upper cover by the pressing sleeve, the decoration cover tightly presses against the lower side of the lower cover, thus fixing and limiting the positions of the upper cover and the lower cover; and stabilizing the crystal slabs. This enables simpler snap-fit fixing. By pressing and fixing, the stability is increased, and the situation that the crystal slabs are easy to fall off due to the looseness of the crystal plate when subjected to external force is reduced. When one of the crystal slabs is damaged, the crystal slabs can be disassembled and replaced quickly, which makes the installation and repair of the equipment more convenient and economical.

BRIEF DESCRIPTION OF DRAWINGS

In order to illustrate the technical solutions of the embodiments of the present invention more clearly, the following briefly introduces the accompanying drawings used in the embodiments. It is to be understood that the following drawings illustrate only certain embodiments of the invention and are therefore not to be considered limiting of its scope. For those of ordinary skill in the art, other related drawings can also be obtained from these drawings without any creative effort.

In the figures: 100—hanging rod assembly; 110—hanging bracket; 120—decorative cover; 130—pressing sleeve; 140—pressing frame; 141—pressing plate; 142—pressing strip; 150—fixing sleeve; 200—lampshade assembly; 210—upper cover; 211—annular cover body; 212—mounting groove; 213—slot; 220—lower cover; 221—pressing cover plate; 222—positioning cover plate; 230—crystal slab; 231—crystal piece; 2311—crystal sheet; 2312—metal frame; 232—bump; 240—vertical partition plate.

DETAILED DESCRIPTION

In order to make the purposes, technical solutions and advantages of the embodiments of the present invention clearer, the technical solutions in the embodiments of the present invention will be described clearly and completely below with reference to the accompanying drawings in the embodiments of the present invention. Obviously, the described embodiments are some, but not all, embodiments of the present invention. Based on the embodiments of the present invention, all other embodiments obtained by those of ordinary skill in the art without creative efforts shall fall within the protection scope of the present invention.

Embodiment

Please refer to FIGS. 1 to 8, the present invention provides a crystal lampshade, which comprises a hanging rod assembly 100 and a lampshade assembly 200.

Figure 1:
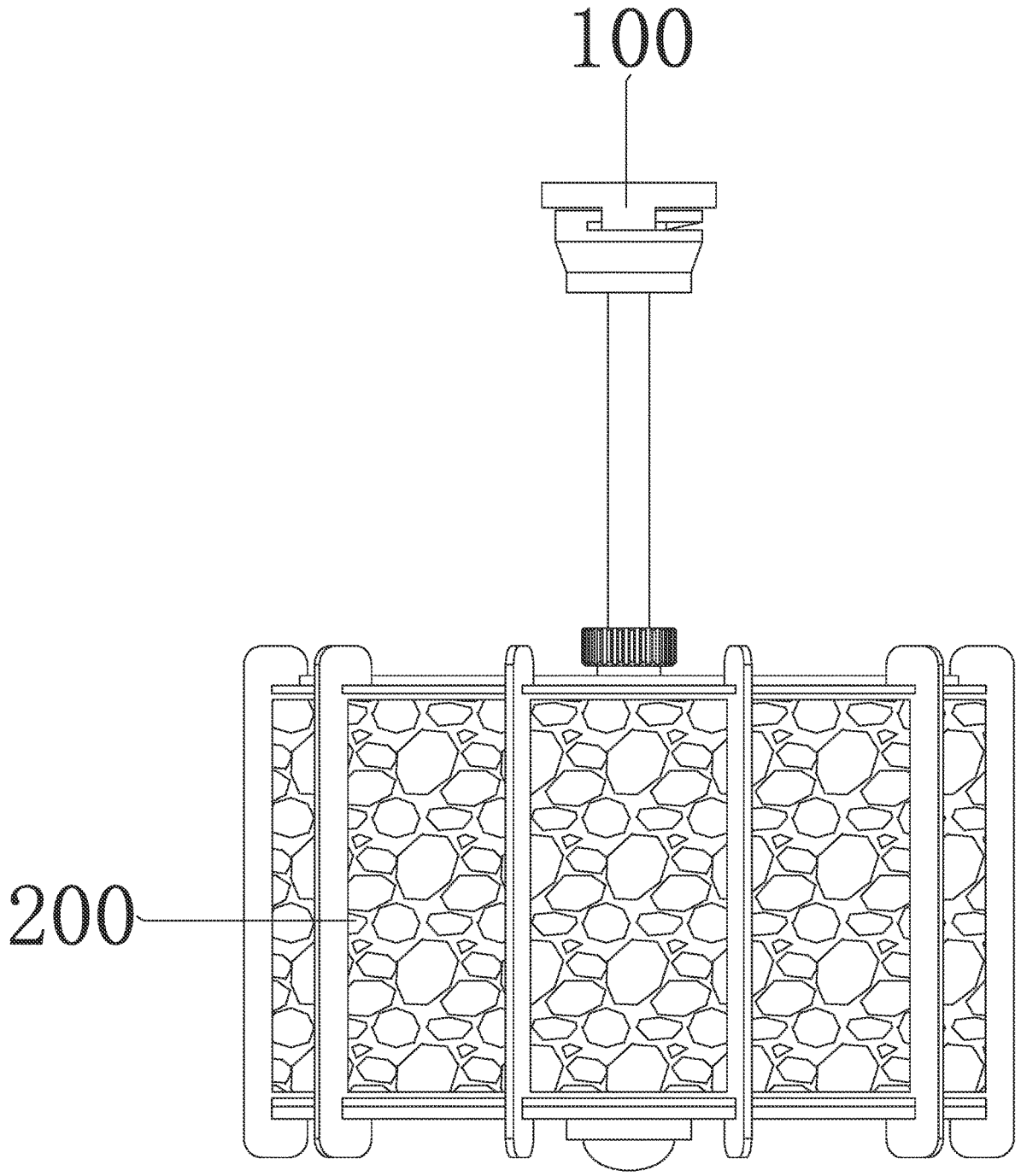
FIG. 1 is a structural schematic diagram of a crystal lampshade according to an embodiment of the present invention.
Figure 2:
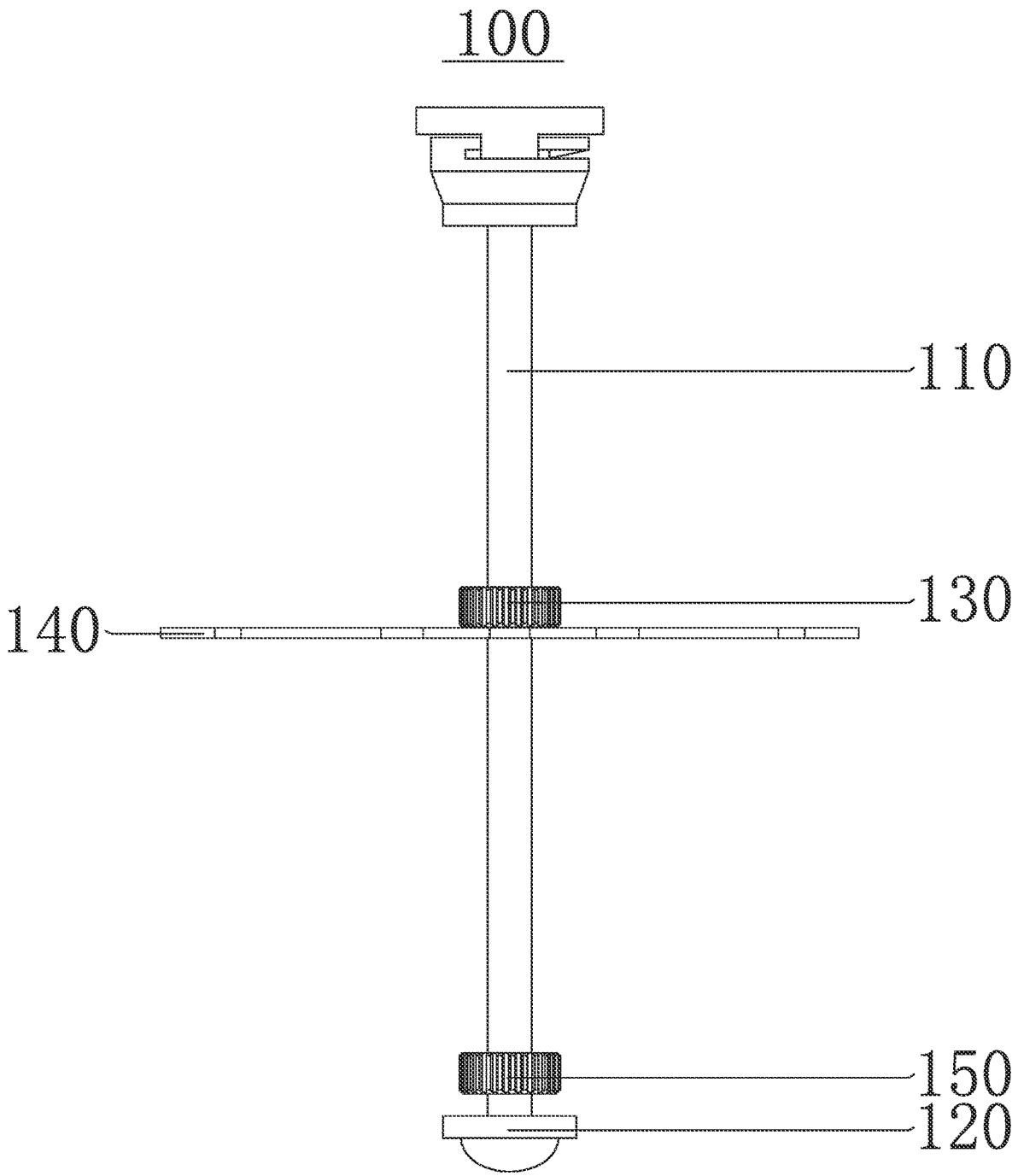
FIG. 2 is a schematic structural diagram of a hanging rod assembly according to an embodiment of the present invention.

Please refer to FIG. 2, the hanging rod assembly 100 comprises a hanging bracket 110, a decorative cover 120, a pressing sleeve 130 and a pressing frame 140. The decorative cover 120 is fixedly connected to the bottom end of the hanging bracket 110, the pressing sleeve 130 is threadedly sleeved on the hanging bracket 110, and the pressing frame 140 is slidably sleeved on the hanging bracket 110.

Figure 3:
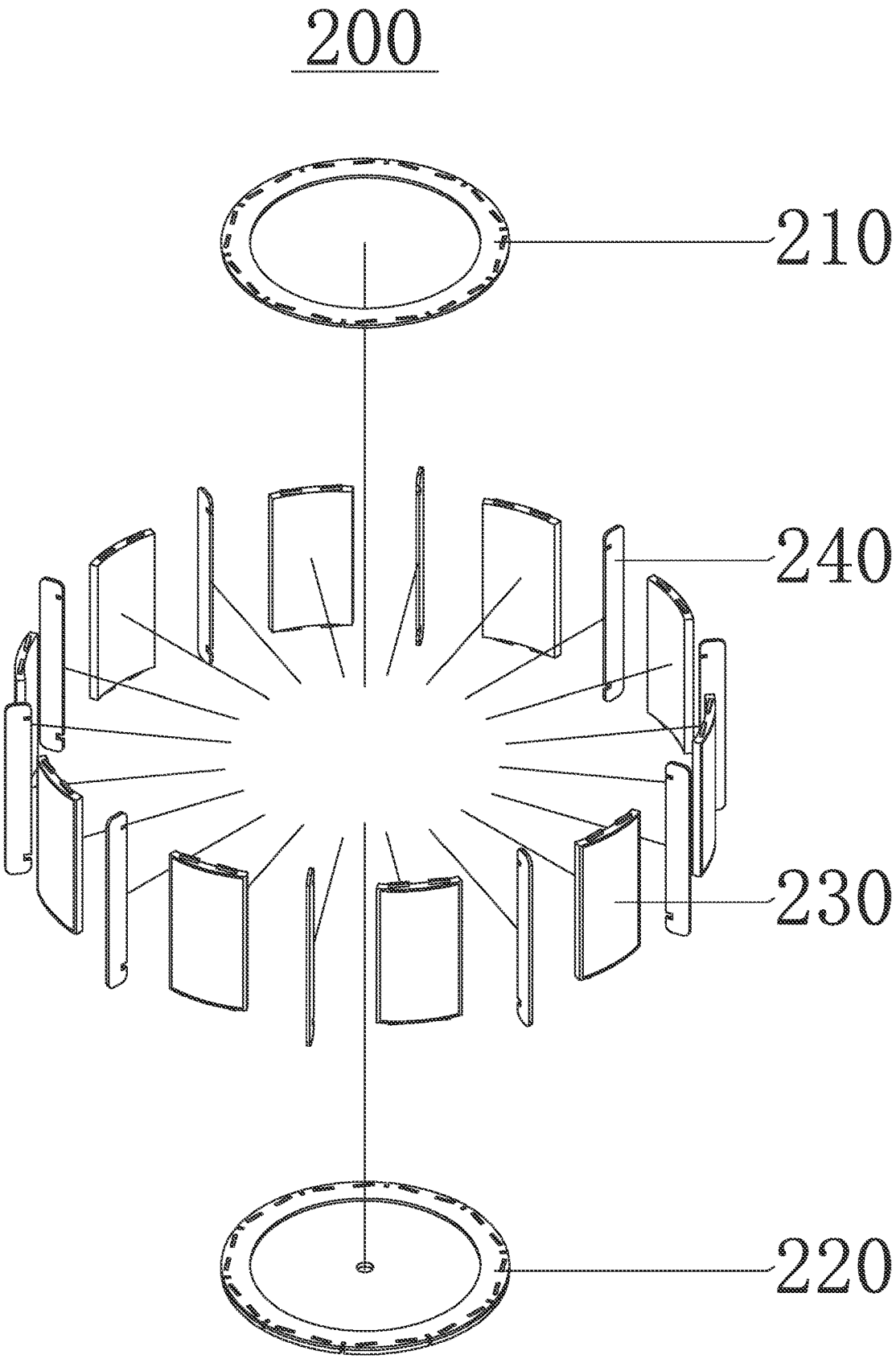
FIG. 3 is a schematic exploded structural diagram of a lampshade assembly according to an embodiment of the present invention.

Please refer to FIG. 3, the lampshade assembly 200 comprises an upper cover 210, a lower cover 220 and crystal slabs 230, two ends of the crystal slab 230 are respectively inserted between the upper cover 210 and the lower cover 220, the crystal slabs 230 are arranged at equal intervals along the periphery of the upper cover 210, the lower end of the hanging bracket 110 passes through the lower cover 220, the decorative cover 120 is pressed against the lower cover 220, and the pressing sleeve 130 presses the pressing frame 140 against the upper cover 210. During use, the crystal slabs 230 are respectively inserted between the upper cover 210 and the lower cover 220, and then the hanging bracket 110 passes through the pressing sleeve 130 and is threadedly sleeved onto the hanging bracket 110, the pressing frame 140 is sleeved in a hanging bracket 110, a lower end of the hanging bracket 110 passes through a lower cover 220, a decorative cover 120 is mounted, and a pressing sleeve 130 is rotated, the pressing sleeve 130 gradually tightly presses the pressing frame 140 on the upper side of the upper cover 210, and the decorative cover 120 tightly presses the lower side of the lower cover 220, thus fixing and limiting the positions of the upper cover 210 and the lower cover 220, and stabilizing the crystal slabs 230. This enables simpler snap-fit fixing. By pressing and fixing, the stability is increased, and the situation that the crystal slabs 230 is easy to fall off due to the looseness of the crystal slabs 230 when subjected to external force is reduced. When one of the crystal slabs 230 are damaged, the crystal slabs 230 can be disassembled and replaced quickly, this makes the installation and repair of the equipment more convenient and economical.

Figure 4:
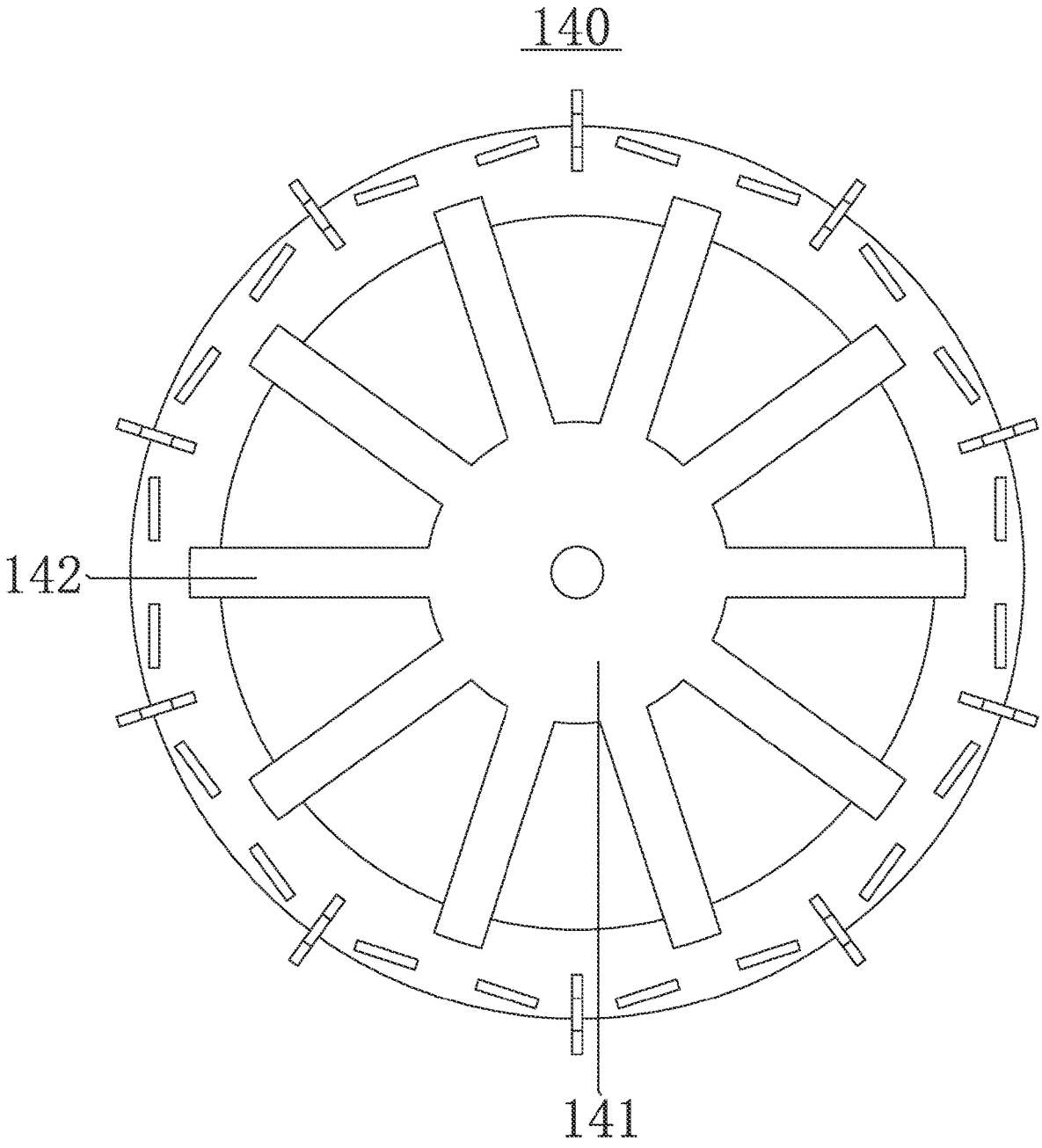
FIG. 4 is a schematic structural diagram of a pressing frame according to an embodiment of the present invention.

Please refer to FIG. 4, the pressing frame 140 comprises a pressing plate 141 and pressing strips 142, wherein the pressing strips 142 are arranged at equal intervals on the periphery of the pressing plate 141, and the pressing strips 142 are pressed against the upper cover 210 respectively. Gaps are reserved between the pressing strips 142 for the bulb to pass through. A fixing sleeve 150 is threadedly sleeved onto a lower end of the hanging bracket 110; and the fixing sleeve 150 is pressed against an upper side of the lower cover 220.

Figure 5:
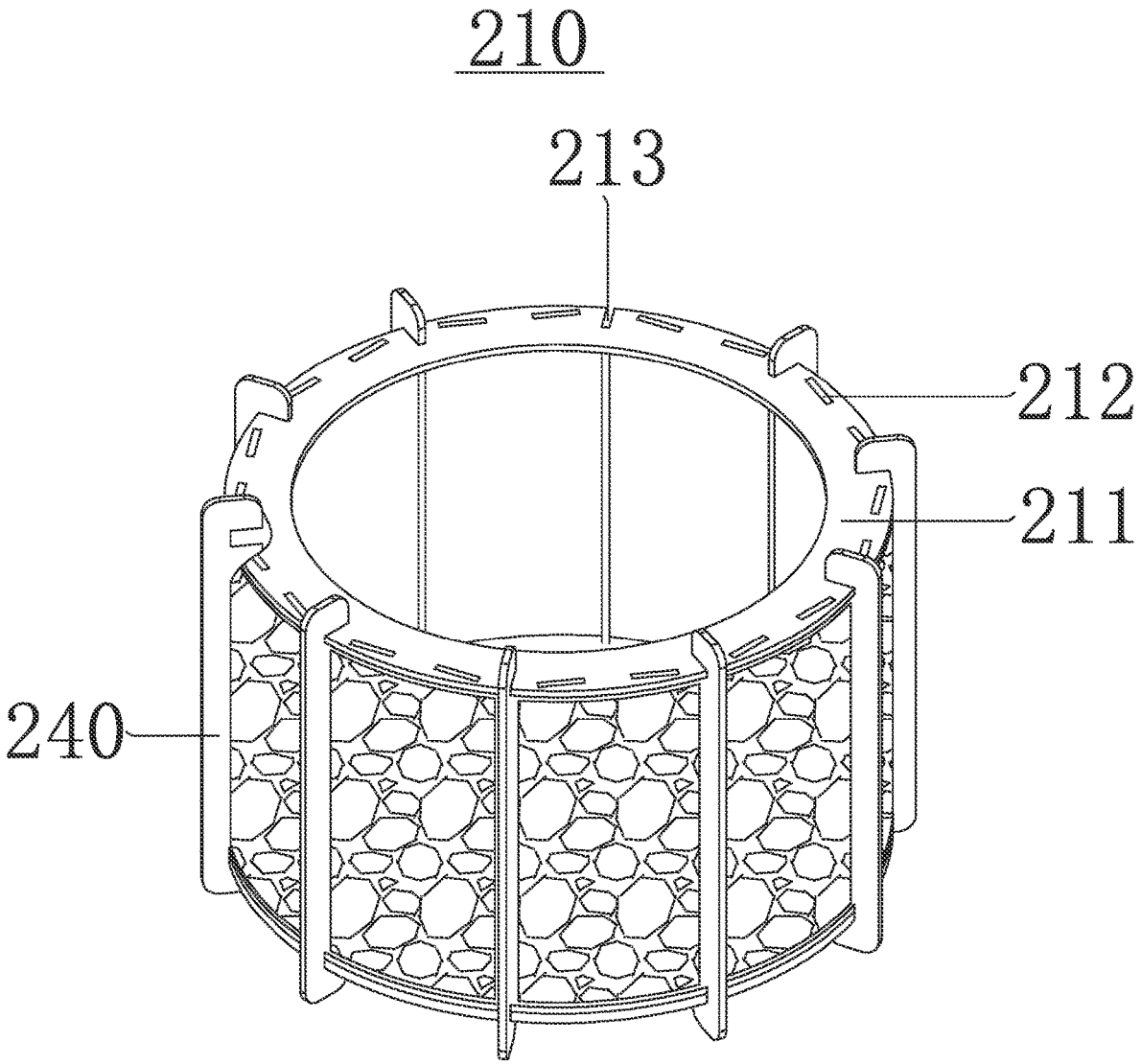
FIG. 5 is a schematic structural diagram of an upper cover according to an embodiment of the present invention.

Please refer to FIG. 5, the upper cover 210 comprises an annular cover 211, the annular cover 211 is uniformly provided with mounting grooves 212, and an upper end of the crystal slab 230 is inserted into the mounting groove 212.

Figure 6:
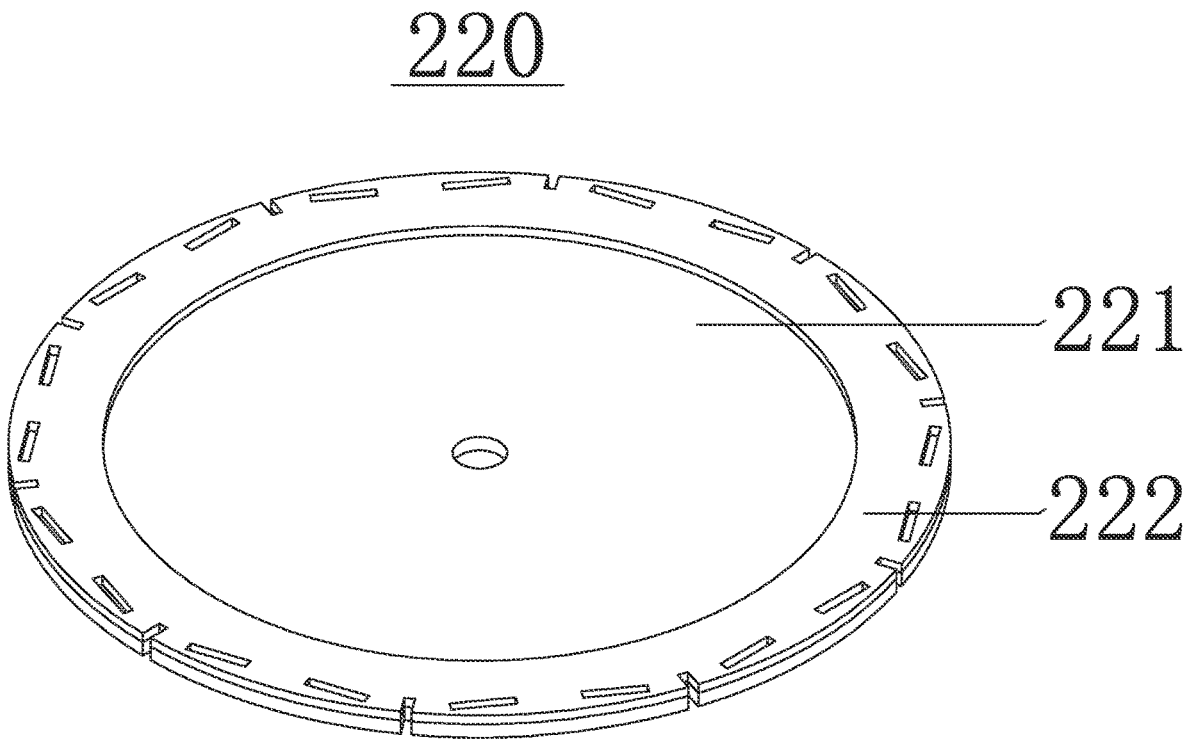
FIG. 6 is a structural schematic diagram of a lower cover according to an embodiment of the present invention.

Please refer to FIG. 6, the lower cover 220 comprises a pressing cover plate 221 and a positioning cover plate 222. The positioning cover 222 is provided with second mounting grooves, and the lower end of the crystal plate 230 is inserted into the second mounting groove, and the decoration cover 120 is pressed against the lower side of the pressing cover plate 221. A vertical partition plate 240 is provided between the crystal slabs 230; the periphery of the annular cover body 211, the pressing cover plate 221 and the positioning cover plate 222 are correspondingly provided with slots 213; and upper and lower ends of the vertical partition plate 240 are respectively inserted into the slots 213. By clamping the upper cover 210 and the lower cover 220 by the vertical partition plate 240, the upper cover 210 and the lower cover 220 and the crystal slabs 230 are positioned and fixed before the pressing sleeve 130 is pressed.

Figure 7:
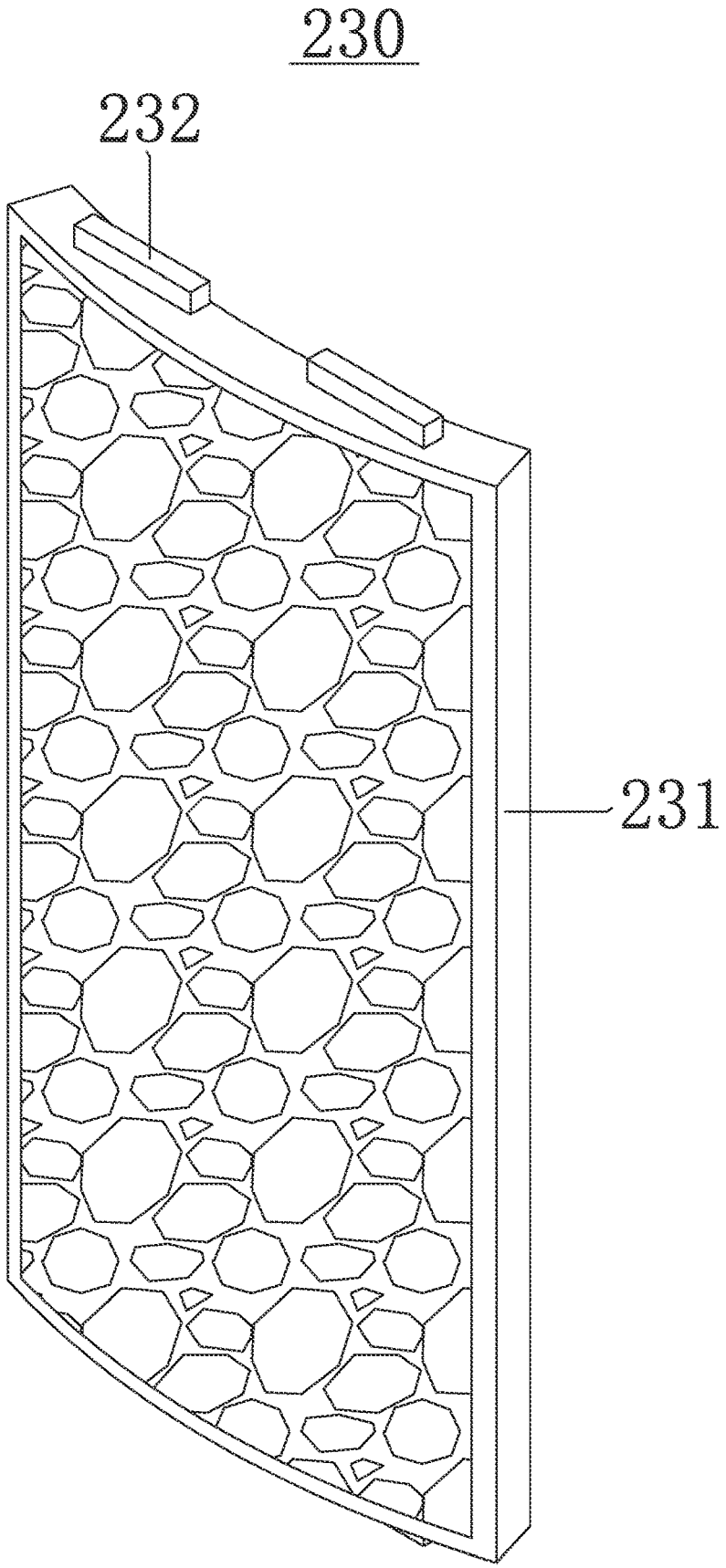
FIG. 7 is a structural schematic diagram of a crystal slab according to a embodiment of the present invention.

Please refer to FIG. 7, the crystal slab 230 comprises a crystal piece 231 and bumps 232. The bumps 232 are respectively arranged at upper and lower ends of the crystal piece 231, and the bumps 232 are respectively inserted into the mounting groove 212 of the annular cover 211 and the positioning cover 222. The crystal piece 231 can be positioned and fixed between the annular cover 211 and the positioning cover plate 222 through the bumps 232.

Figure 8:
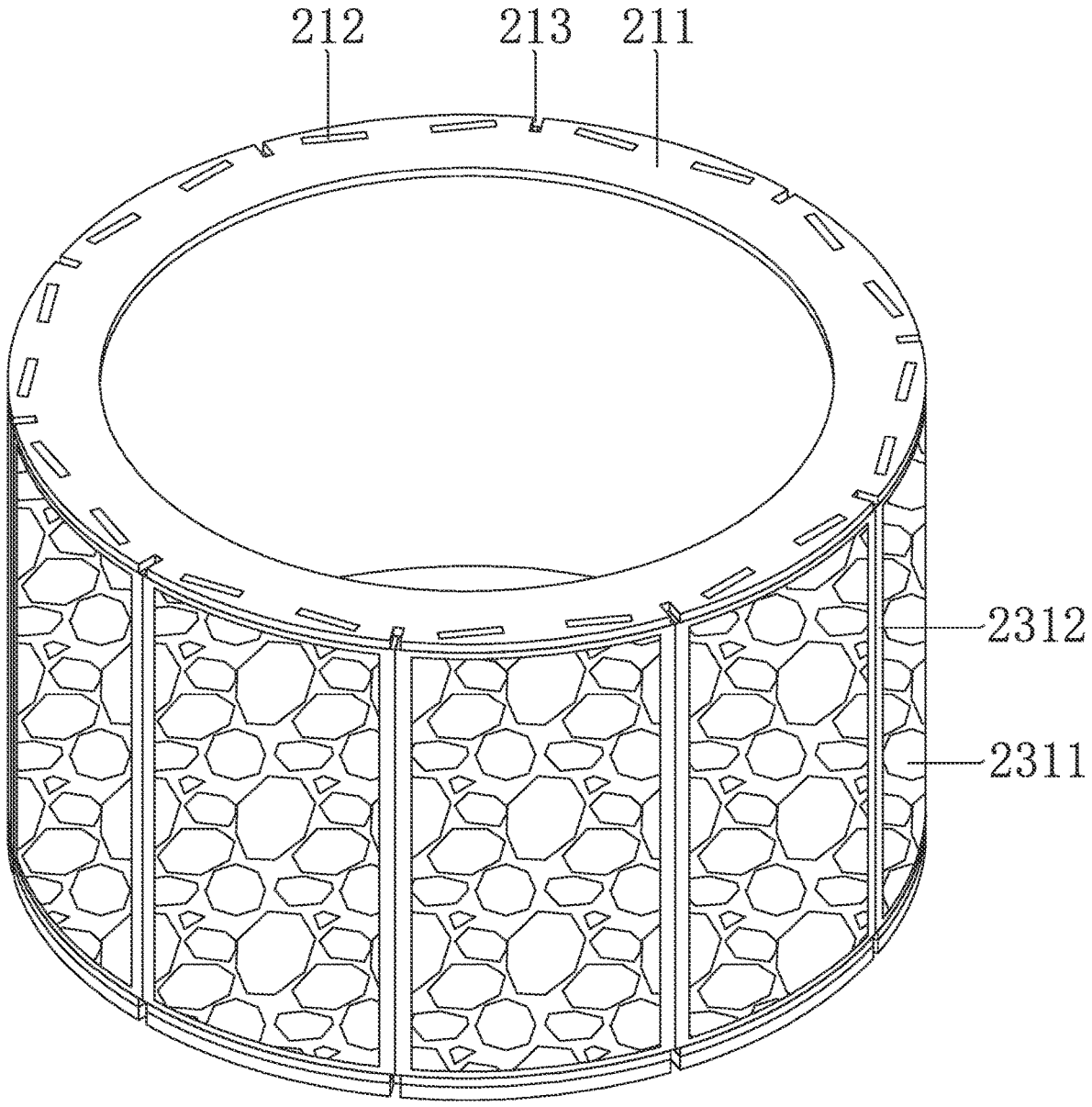
FIG. 8 is a structural schematic diagram of a crystal lampshade in which crystal pieces are welded according to an embodiment of the present invention.

Please refer to FIG. 8, the crystal piece 231 comprises a crystal sheet 2311 and a metal frame 2312. The crystal sheet 2311 is embedded into the metal frame 2312. The metal frame 2312 is used to protect the crystal sheet 2311 fixed inside the metal frame 2312. The crystal sheet 2311 is formed by adhering and casting crystal particles and epoxy adhesive. By means of the crystal particles and the epoxy adhesive provided, when the device is used, the crystal particles are bonded by means of the epoxy adhesive, and the metal frame 2312 is fixedly mounted on the periphery to support the crystal sheet 2311, so that when the device is used, the natural color of each natural crystal can be perfectly refracted by means of lamplight, and the appearance is fashionable, which conforms to the esthetics of modern people. It should be noted that the vertical partition plate 240 may not be arranged between the metal frames 2312, and in order to ensure the whole stability of the crystal lampshade, the metal frames 2312 of the whole crystal lampshade may be welded.

Specifically, the operation principle of the crystal lampshade is as follows: when in use, the bumps 232 on the crystal piece 231 are respectively inserted into the mounting grooves 212 of the annular cover body 211 and the positioning cover plate 222, upper and lower ends of the vertical partition plate 240 are respectively inserted into the slots 213, and the annular cover body 211 and the positioning cover plate 222 are fixed in advance, Then, the hanging bracket 110 is threadedly sleeved on onto the hanging bracket 110 through the pressing sleeve 130, and the pressing frame 140 is sleeved into the hanging bracket 110, the lower end of the hanging bracket 110 passes through the pressing cover plate 221, the decorative cover 120 is mounted, the pressing sleeve 130 is rotated, and the pressing sleeve 130 gradually presses the pressing frame 140 onto the upper side of the annular cover body 211, The decorative cover 120 tightly presses against the lower side of the cover plate 221, so as to fix and limit the positions of the upper cover 210 and the lower cover 220, and stabilize the crystal piece 231. This enables simpler snap-fit fixing. By pressing and fixing, the stability is increased, and the situation that the crystal pieces 231 are easy to fall off due to the looseness of the crystal pieces when subjected to external force is reduced. When one of the crystal pieces 231 is damaged, the crystal piece can be disassembled and replaced quickly, which makes the installation and repair of the equipment more convenient and economical.

By means of the crystal particles and the epoxy adhesive provided, when the device is used, the crystal particles are bonded by means of the epoxy adhesive, and a metal frame 2312 is fixedly mounted on the periphery to support a crystal sheet 2311, so that when the device is used, the natural color of each natural crystal can be perfectly refracted by means of lamplight, and the appearance is fashionable, which conforms to the esthetics of modern people.

The above are only preferred embodiments of the present invention, and are not intended to limit the present invention. For those skilled in the art, the present invention may have various modifications and changes. Any modification, equivalent replacement, improvement, etc. made within the spirit and principle of the present invention shall fall within the protection scope of the present invention.

What is claimed is:

1. A crystal lampshade, comprising:

a hanging rod assembly, the hanging rod assembly comprising a hanging bracket, a decorative cover, a pressing sleeve and a pressing frame, wherein the decorative cover is fixedly connected to a bottom end of the hanging bracket, the pressing sleeve is threadedly sleeved on the hanging bracket, and the pressing frame is slidably sleeved on the hanging bracket;

a lampshade assembly, the lampshade assembly comprising an upper cover, a lower cover and crystal slabs, two ends of the crystal slab are respectively inserted between the upper cover and the lower cover, the crystal slabs are arranged at equal intervals along the periphery of the upper cover, a lower end of the hanging bracket passes through the lower cover, the decorative cover is pressed against the lower cover, and the pressing sleeve presses the pressing frame against the upper cover.

2. The crystal lampshade according to claim 1, wherein the pressing frame comprises a pressing plate and pressing strips, wherein the pressing strips are arranged at equal intervals on the periphery of the pressing plate, and the pressing strips are pressed against the upper cover.

3. The crystal lampshade according to claim 1, wherein a fixing sleeve is threadedly sleeved on the lower end of the hanging bracket, and the fixing sleeve is tightly pressed against an upper side of the lower cover.

4. The crystal lampshade according to claim 1, wherein the upper cover comprises an annular cover body, the annular cover body is uniformly provided with mounting grooves, and an upper end of the crystal slab is inserted into the mounting groove.

5. The crystal lampshade according to claim 4, wherein the lower cover comprises a pressing cover plate and a positioning cover plate, the positioning cover plate and the annular cover body are configured to have the same structure, a lower end of the crystal slab is inserted into the mounting groove on the positioning cover plate, and the decorative cover is pressed against a lower side of the pressing cover plate.

6. The crystal lampshade according to claim 5, wherein the crystal slab comprises a crystal piece and bumps, the bumps are respectively arranged at upper and lower ends of the crystal piece, and the bumps are respectively inserted into the mounting groove of the annular cover body and the positioning cover plate.

7. The crystal lampshade according to claim 6, wherein the crystal piece comprises a crystal sheet and a metal frame, and the crystal sheet is embedded into the metal frame.

8. The crystal lampshade according to claim 7, wherein the crystal sheet is formed by adhering and casting crystal particles and epoxy adhesive.

9. The crystal lampshade according to claim 5, wherein a vertical partition plate is disposed between the crystal slabs, slots are correspondingly arranged on peripheries of the annular cover body, the pressing cover plate and the positioning cover plate, and upper and lower ends of the vertical partition plate are respectively inserted into the slot.

* * * * *